US012330843B2

(12) United States Patent
McLeod et al.

(10) Patent No.: US 12,330,843 B2
(45) Date of Patent: Jun. 17, 2025

(54) DISPLAY TRAY FOR IMPROVED PRODUCT VISIBILITY

(71) Applicant: WestRock CP, LLC, Atlanta, GA (US)

(72) Inventors: Michael McLeod, Romeoville, IL (US); Andrew Laackman, Wilmette, IL (US)

(73) Assignee: Westrock CP LLC, Atlanta, GA (US)

( * ) Notice: Subject to any disclaimer, the term of this patent is extended or adjusted under 35 U.S.C. 154(b) by 245 days.

(21) Appl. No.: 17/587,141

(22) Filed: Jan. 28, 2022

(65) Prior Publication Data

US 2022/0258906 A1 Aug. 18, 2022

Related U.S. Application Data

(60) Provisional application No. 63/148,681, filed on Feb. 12, 2021.

(51) Int. Cl.

| | |
|---|---|
| ***A47B 87/02*** | (2006.01) |
| ***A47F 5/00*** | (2006.01) |
| ***A47F 5/11*** | (2006.01) |
| ***B65D 5/00*** | (2006.01) |
| ***B65D 5/22*** | (2006.01) |
| ***B65D 5/49*** | (2006.01) |
| ***B65D 5/50*** | (2006.01) |

(52) U.S. Cl.

CPC ..... *B65D 5/0025* (2013.01); *A47B 87/0269* (2013.01); *A47F 5/005* (2013.01); *A47F 5/114* (2013.01); *B65D 5/005* (2013.01); *B65D 5/0055* (2013.01); *B65D 5/22* (2013.01); *B65D 5/48034* (2013.01); *B65D 5/5028* (2013.01); *B65D 5/5038* (2013.01)

(58) Field of Classification Search

CPC ..... B65D 5/0025; B65D 5/0055; B65D 5/22; B65D 5/48034; B65D 5/5028; B65D 5/5038; B65D 21/0204; B65D 21/0202; B65D 21/0201; A47B 87/0269; A47F 5/005; A47F 5/114

See application file for complete search history.

(56) References Cited

U.S. PATENT DOCUMENTS 5,984,120 A * 11/1999 Johnske ..... A47F 5/116 211/132.1

2021/0261285 A1 8/2021 Bersamin

FOREIGN PATENT DOCUMENTS

JP 2006264777 A * 10/2006

* cited by examiner

*Primary Examiner* — Anthony D Stashick
*Assistant Examiner* — L Kmet
(74) *Attorney, Agent, or Firm* — Neil G. Cohen; Rohini K. Garg

(57) ABSTRACT

A display tray system including a first tray defining an outer perimeter of the display tray system, a second tray having at least three outer walls defining an outer perimeter of the display tray system, a first corner having a first height at a junction of two of the at least three outer walls, a second corner having a height equal to the first corner at a junction of two of the at least three outer walls, a joining wall defining an inner border with the first tray, a third corner at a junction of the joining wall and one of the at least three outer walls, a fourth corner at a junction of the joining wall and one of the at least three outer walls, and a joining member coupled to the joining wall of the first tray and coupled to the joining wall of the second tray to couple the first and second trays together and provide vertical support.

18 Claims, 17 Drawing Sheets

DISPLAY TRAY FOR IMPROVED PRODUCT VISIBILITY

CROSS-REFERENCE TO RELATED APPLICATION

The subject application claims the benefit of priority to U.S. Provisional Patent Application Ser. No. 63/148,681, which was filed on Feb. 12, 2021, the contents of which are incorporated by reference herein in its entirety.

BACKGROUND

Technological Field

The present disclosure relates generally to a display tray, and specifically to a display tray having improved visibility and stacking abilities.

Description of Related Art

Pallet displays in Club Stores are beneficial since a large amount of product can be merchandised in one location without having to be re-stocked often. Many of these designs incorporate a full depth "X" or similar divider insert that separates the tray into quadrants and spans the corners, providing critical stacking support for the multiple tray layers, that is locked into a low profile base tray. However, the "X" dividers tend to obstruct the customer's view of the product, particularly when the primary customer facing side of the display has been emptied and product in the other quadrants are difficult to see or cannot be seen by the customer because the insert blocks the view. These trays are hard to or impossible to rotate in order to show what product is located in the other quadrants. Further, the dividers cannot be removed without affecting the integrity of the tray stack.

There is still a need in the art for improved display trays having improved stacking abilities and visibility to each corner of the tray from multiple vantage points. The present disclosure provides a solution for this need.

SUMMARY OF THE INVENTION

A display tray system includes a first tray having at least three outer walls defining an outer perimeter of the display tray system, a first corner having a first height at a junction of two of the at least three outer walls, a second corner having a height equal to the first corner at a junction of two of the at least three outer walls, a joining wall defining an inner border with a second tray, a third corner having at a junction of the joining wall and one of the at least three outer walls, a fourth corner having at a junction of the joining wall and one of the at least three outer walls, a second tray having at least three outer walls defining an outer perimeter of the display tray system, a first corner having a first height at a junction of two of the at least three outer walls, a second corner having a height equal to the first corner at a junction of two of the at least three outer walls, a joining wall defining an inner border with the first tray, a third corner having at a junction of the joining wall and one of the at least three outer walls, a fourth corner at a junction of the joining wall and one of the at least three outer walls, and a joining member coupled to the joining wall of the first tray and coupled to the joining wall of the second tray to couple the first and second trays together and provide vertical support.

The joining member includes an upper wall which can define a horizontal plane at a vertical height equal to the height of the first corner and second corner of the first tray and the first corner and the second corner of the second tray. The upper wall of the joining member can join a first support to a second support. The first support can be partially within the first tray and partially within the second tray. The first support can include a pair of support wings hingedly attached thereto and the second support can include a pair of wings hingedly attached thereto. The first support wing of the first support and the first support wing of the second support can be within the first tray and the second support wing of the first support and the second support wing of the second support are within the second tray.

An underside of the upper wall of the joining member and the upper edge of the joining walls of the first tray and the second tray can define a top and a bottom of an opening. The upper wall can include a plurality of tabs configured to couple a third tray and a fourth tray placed above the first tray and above the second tray. It is also considered that the joining wall of the first tray can include a height lower than the height of the first corner. The third corner of the first tray can include a height lower than the height of the first corner. The third corner of the first tray can includes a height equal to the height of the first corner.

The joining member can be saddle shaped. The joining member can extend up to 60% into the width of both the first tray and the second tray. The joining member can include at least a pair of slots for coupling to the joining wall of the first tray and coupling to the joining wall of the second tray. The joining member can be folded over the joining wall in a face-to-face relationship. The joining member can include a first panel hingedly coupled to a second panel and wherein the first panel includes a punch-out portion and the second panel includes an aperture for receiving the punch-out portion of the first panel.

The first tray can include a floor having at least one slot for accepting a tab of a joining member of a third tray. A third tray can be joined to a fourth tray by a second joining member, wherein the third tray and fourth tray can be joined to the joining member of the first tray and the second tray.

A blank for forming a tray is also disclosed. The blank includes a first panel extended along a longitudinal axis defining a joining wall of the tray, a second panel hingedly coupled to the first panel defining a floor of the tray and two outer walls of the tray, a third panel hingedly coupled to the second panel defining a third outer wall of the tray, wherein the third panel includes a first foursome of sections extended across the longitudinal axis hingedly attached to each other and to a first end of the third panel for defining a first corner post and a second foursome of sections extended across the longitudinal axis hingedly attached to each other and to a second end of the third panel for defining a second corner post. The blank can include several corner configurations including one with or without stacking tabs for coupling to an above tray, a closed corner post, an L-corner post, and a complex post.

The second panel can include a first tab hingedly attached at a first end and a second tab hingedly attached at a second end, wherein each tab includes a fold-out portion configured to partially detach from the tab and fold inwards in order to define a portion of a respective outer wall and to support the outer wall. The second panel can be wider than the first panel, and the second panel can be wider than the third panel. The third panel can include a fold-out tab hingedly attached at a first edge configured to partially detach from third panel and fold inwards in order to define a portion of a respective outer wall and to support the respective outer wall.

A blank for joining a first tray to a second tray is also disclosed. The blank includes a first panel extended along a longitudinal axis including a first end tab hingedly attached to the first end and a second end tab hingedly attached to the second end, a second panel hingedly attached to the first panel configured to define an upper wall of a joining member of a display tray system, and a third panel extended along the longitudinal axis including a first end tab hingedly attached to the first end and a second end tab hingedly attached to the second end. The second panel can include a plurality of tabs configured to bend in and out of a plane defined by the second panel. The first panel and the second panel each include a respective slot partially bisecting the respective panel.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

Figure 1B:
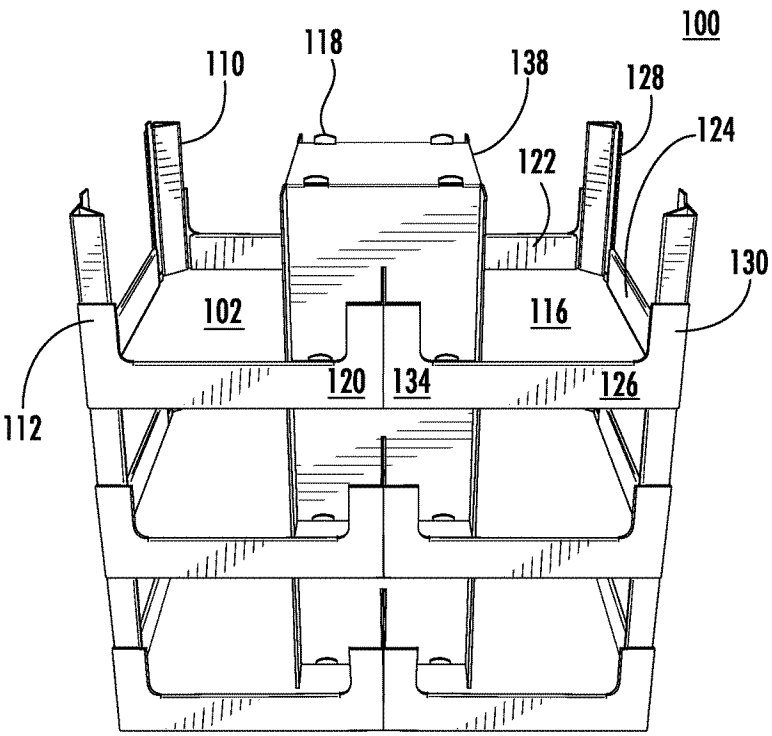
FIG. 1B is a front view of an exemplary embodiment of a tray system according to the disclosure.
Figure 1A:
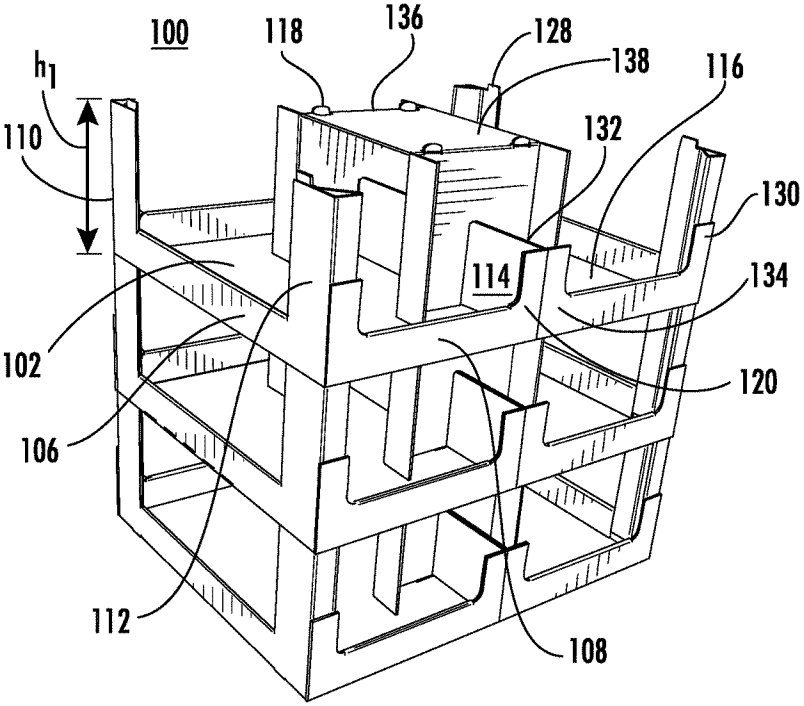
FIG. 1A is a perspective view of an exemplary embodiment of a tray system according to the disclosure.
Figure 12B:
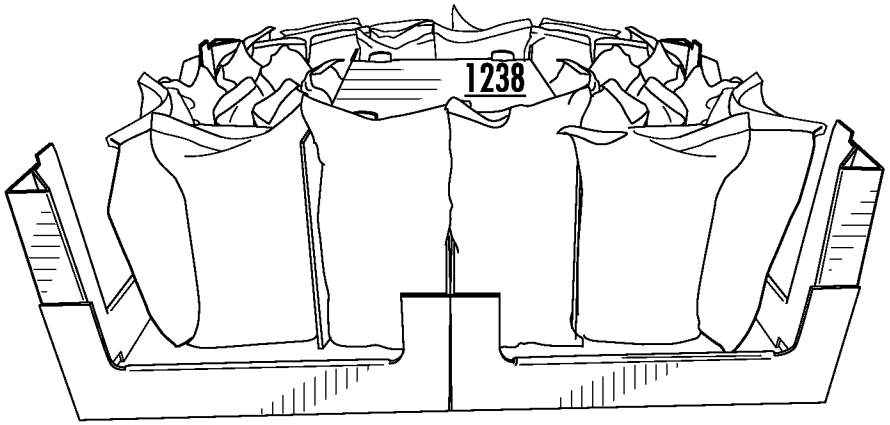
Figure 12A:
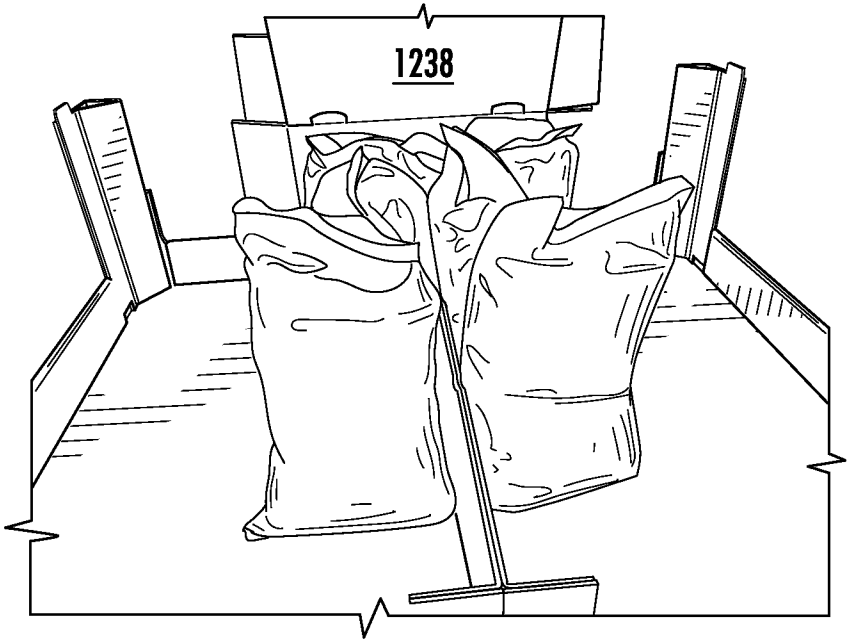

FIGS. 12A and 12B are a perspective view of the trays of FIG. 1*a* filled with product.

DETAILED DESCRIPTION

Reference will now be made to the drawings wherein like reference numerals identify similar structural features or aspects of the subject disclosure. For purposes of explanation and illustration, and not limitation, a partial view of an exemplary tray system in accordance with the disclosure is shown in FIG. 1 and is designated generally by reference character 100. Other embodiments of the tray system, methods of constructing trays in accordance with the disclosure, or aspects thereof, are provided in FIGS. 2-12B, as will be described. The tray systems presented and described below improve product visibility in a display unit common in Club and other large format point of purchase applications, and improve stacking performance and reduce cost to use.

FIGS. 1*a* and 1*b* are perspective views of an exemplary embodiment of a tray system 100 according to the disclosure. The tray system 100 shows a first tray 102 having three outer walls 104, 106, 108, a first corner 110 having a first height (hl) at a junction of two of the outer walls 104/106, a second corner 112 having a height equal to the first corner 110 at a junction of two other outer walls 106/108, a joining wall 114 defining an inner border with a second tray 116, a third corner 118 at a junction of the joining wall 114 and outer wall 104, a fourth corner 120 at a junction of the joining wall 114 and outer wall 108. The second tray 116 similarly includes three outer walls 122, 124, 126, a first corner 128, a second corner 130, a joining wall 132, a third corner 134, and a fourth corner 136. A joining member 138 coupled to the joining wall of the first tray 114 and coupled to the joining wall of the second tray 132 to couple the first 102 and second 116 trays and provide vertical support to the tray system 100 when other trays loaded with product are stacked on top. It is also considered that four trays can be combined with a joining member joining them all together and supported by a single joining member or a system of joining members.

Figure 1C:
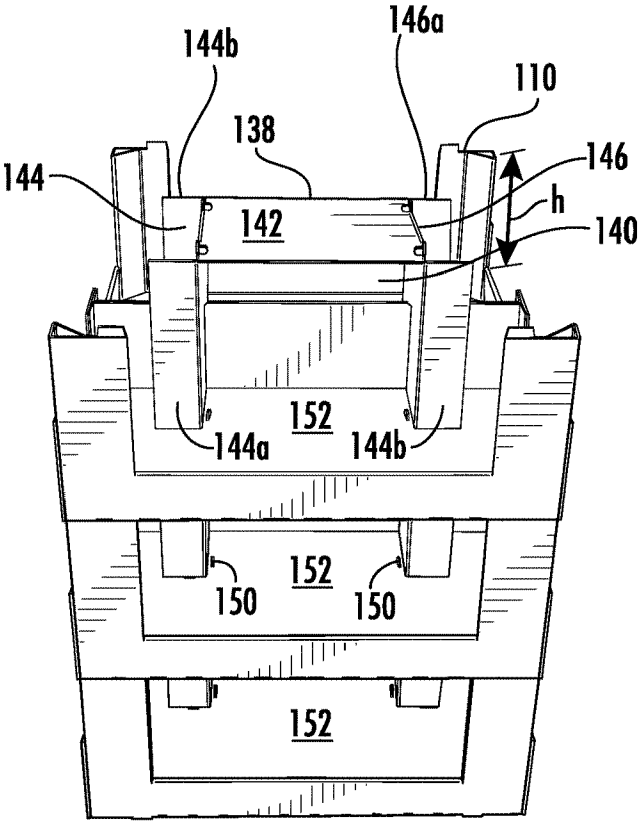
FIG. 1C is a side view of an exemplary embodiment of a tray system according to the disclosure showing a window between the middle support and the joining wall.

FIG. 1*c* is a side view the tray system 100. The joining member 138 includes a flat upper wall 142 level to the height of the first corners 110 and second corners 112 of the first tray 102. The upper wall 142 of the saddle shaped joining member 138 joins a first support 144 and a second support 146. The first support 144 and the second support 146 each straddle the joining walls 114/132 of each of the trays and are partially within the first tray 102 and partially within the second tray 116. Each of the supports 146/144 includes a pair of support wings 146*a*/146*b* and 144*a*/144*b* respectively hingedly attached thereto. The supports wings 146*a*/146*b* and 144*a*/144*b* allow for better stability and flexibility in filling the trays with product. The support wings 146*a*/146*b* and 144*a*/144*b* can be positioned at a variety of angles in order to accommodate packages of various shapes and sizes while still providing support against vertical pressures.

Joining member 138 can be self-locking or pre-glued. It is also considered that the joining member can join four quarter trays together using various slit combinations. The supports 146/144 can also include rolled-up 3D self-locked or glued supports that will give further vertical support.

FIG. 1C further shows a window 140 between the joining wall 114 and joining member 138. An underside of the upper wall 146 of the joining member 138 and the upper edge 146 of the joining walls 114/132 of the first tray 114 and the second tray 132 define a top and a bottom of the window 140. The window 140 allows a user to see from one side of the tray system to the other. Not only can a customer see around the joining member 138 to see what is in the back of the tray, but the customer can also see through the joining member 138 to see what is on the other side of the tray, and if needed extract product from that side over the abutting tray walls. Another feature improving sight lines across the tray is having the joining walls 114/132 along with the third corner 118 and fourth corner 120 are below the heights of the first corner 110 and second corner 112.

Figure 2:
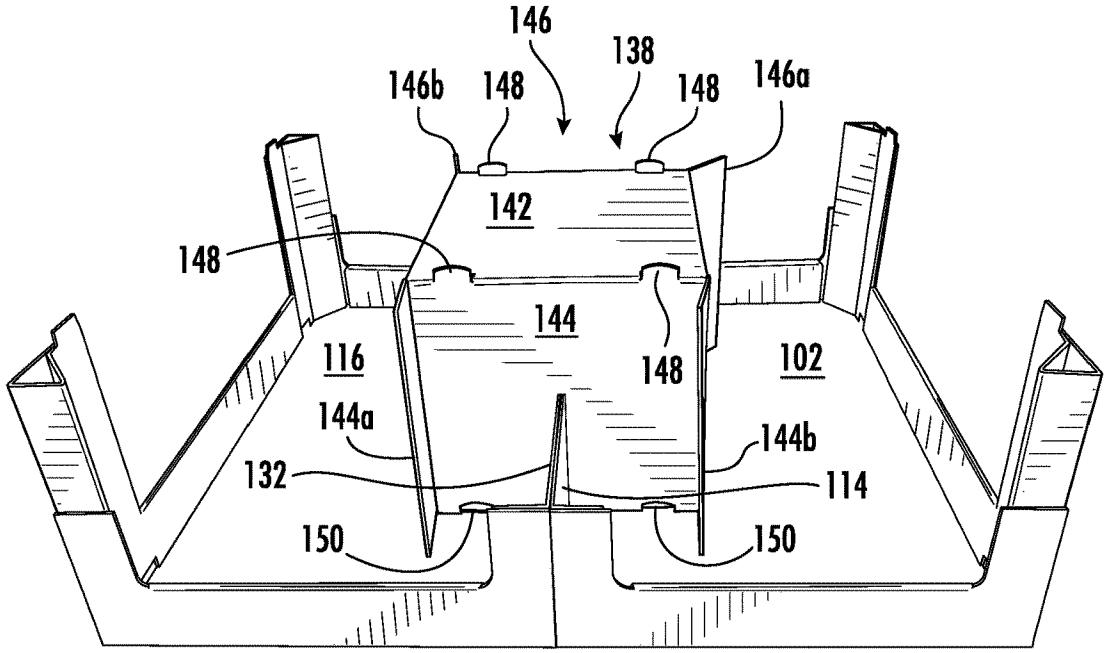
FIG. 2 is a front view of an exemplary embodiment of a pair of trays of the tray system of FIG. 1A.

As seen in FIG. 2, the upper wall 142 includes a plurality of tabs 148 which couple to slots 150 of a floor 152 of a tray 154 above the first tray 102 and the second tray 116. The tabs 148 provide further stability to the tray system seen in FIGS. 1*a*-1*c*. The joining member 138 extends 60% or less into the width of each of the trays. This combination allows for the desired staging of products shown in FIGS. 12A and 12B.

Figure 3A:
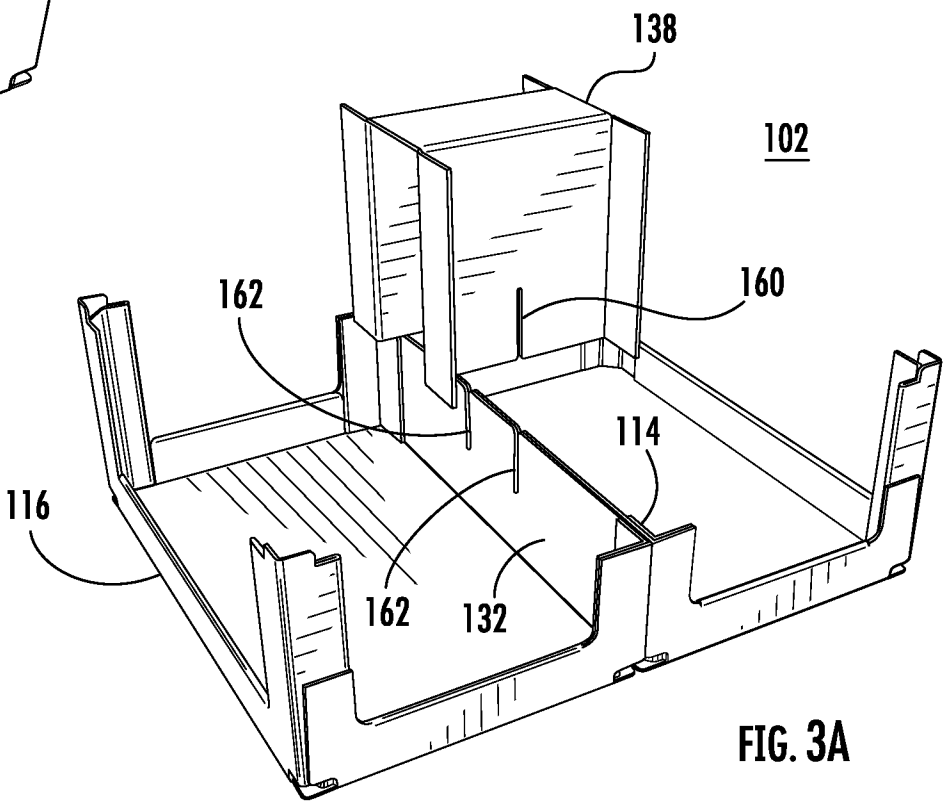
FIG. 3A is a perspective view of an exemplary embodiment of a pair of trays of the tray system of FIG. 1A showing an attachment of the joining member.
Figure 3B:
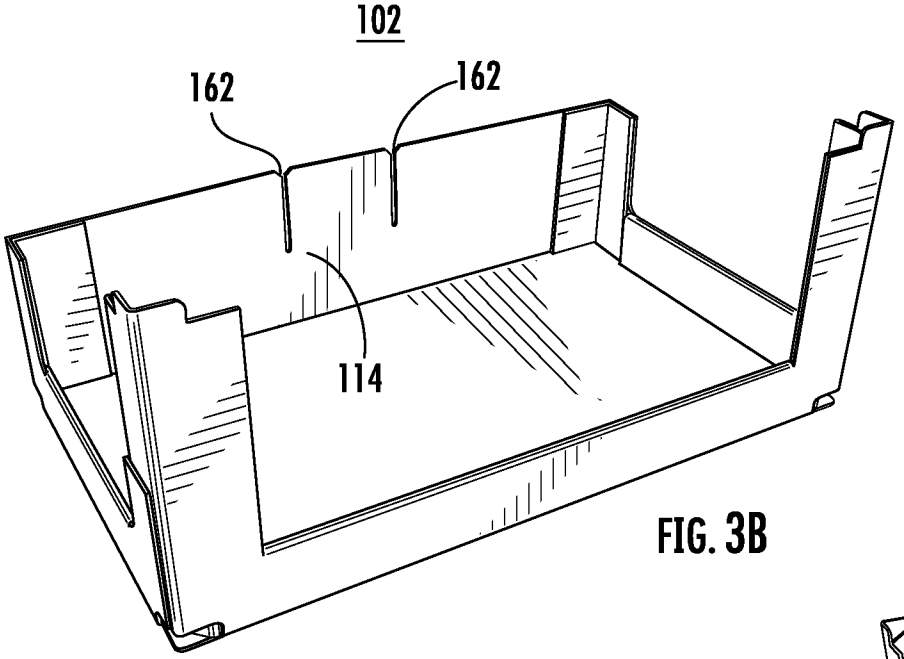
FIG. 3B is a perspective view of an exemplary embodiment of a single tray of the tray system of FIG. 1A.
Figure 4:
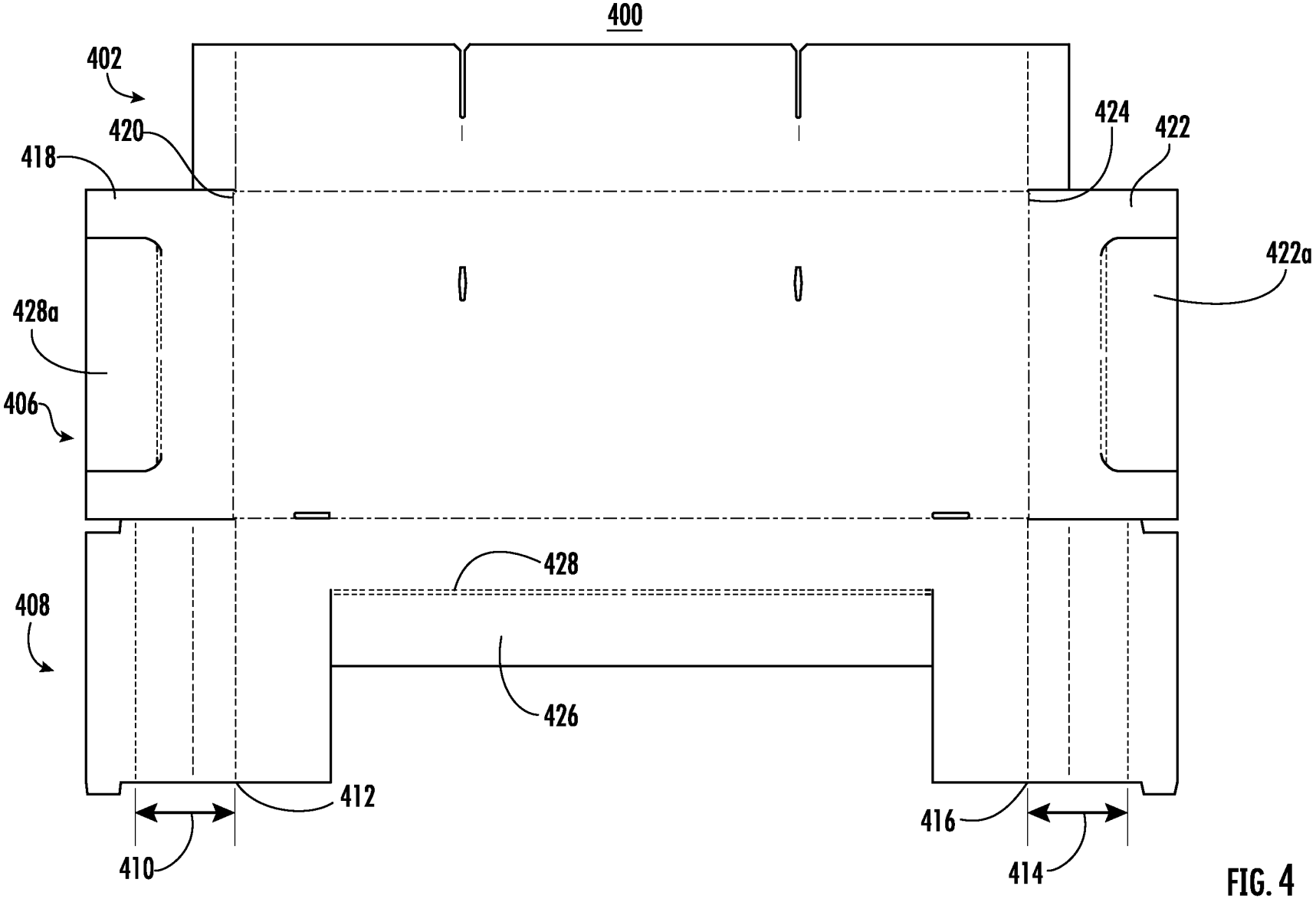
FIG. 4 is a plan view of a blank for constructing the single tray of FIG. 3B.

FIGS. 3A and 3B show a single tray 102 of the tray system of FIGS. 1A-1C. The tray 102 is coupled with the joining member 138 by matching the slots of the joining member 160 with the slots 162 of the joining walls 114/132. FIG. 4 is a plan view of a blank 400 for constructing the single tray shown in FIG. 3B. The blank 400 includes a first panel 402 which defines the joining wall 114 of tray 102. A second panel 406 is hingedly attached to the first panel 402 which defines a floor 152 of tray 102 and outer walls 104 and 108 of tray 102. A third panel 408 is hingedly attached to the second panel 406 and defines the third outer wall 106 of tray 102. The third panel 408 includes a first foursome 410 of sections extended across the third panel 408 hingedly attached to each other and to a first end 412 of the third panel 408. The first foursome 410 defines a first corner post 110 of tray 102. A second foursome of sections 414 at a second end 416 define the second corner post 112. It should be understood to one of ordinary skill in the art that multiple variations and combinations of corners. Details of possible corners are shown and discussed in FIGS. 10A-10J.

The second panel 406 includes a first tab 418 hingedly attached at a first end 420 and a second tab 422 hingedly attached at a second end 424. Each tab includes a respective fold-out portion 422*a*/418*a* to partially detach from the respective tab 422/418 and fold inwards in order to define a portion of a respective outer wall 104/108 and to support the outer wall. The second panel 406 is generally wider than the first panel 402, and the second panel 406 is generally wider than the third panel 408. However, it should be understood that various configurations and dimensional combinations can be used to create a desired tray. The third panel 408 includes a fold-out tab 426 hingedly attached at a first edge 428 to partially detach from the third panel 408 and fold inwards in order to define a portion of outer wall 406 and to provide added thickness to outer wall 406.

FIG. 5A-6B show another possible features of the previously discussed tray system. It should be understood that the tray system 500 shown here includes all of the features previously discussed but adds height to the third corner post 518 and the fourth corner post 520. The height of the third corner 518 and fourth corner 520 is equal to the height of the first corner 510 and the second corner 512. In sacrificing visibility and lines of sight the higher corner posts 518 allows for greater weight support in the tray system 500. The added stability also allows the joining member 538 to forgo tabs that get placed within the above tray.

Figure 7:
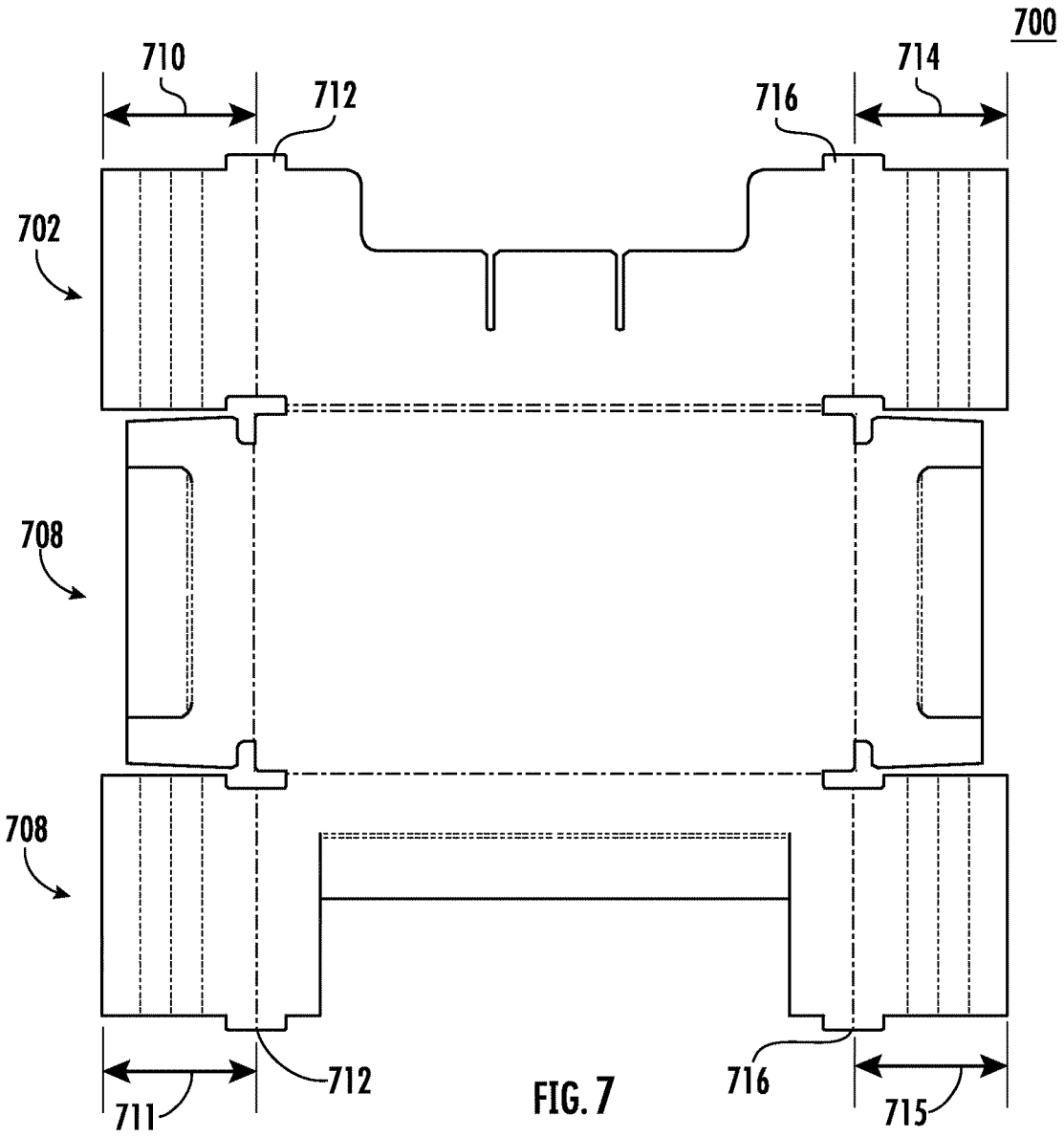
FIG. 7 is a plan view of a blank for constructing the single tray of FIG. 6B.

FIG. 7 shows a plan view of a blank 700 for constructing the single tray of FIGS. 5A-6B. Similarly to the previously discussed blank 400, the blank 700 includes a first panel 702 which defines the joining wall 514 of tray 502. A second panel 706 is hingedly attached to the first panel 702 which defines a floor 552 of tray 502 and outer walls 504 and 508 of tray 502. A third panel 708 is hingedly attached to the second panel 706 and defines the third outer wall 506 of tray 502. The first panel 702 and third panel 708 each includes a respective foursome 710/711 of sections extended across the respective panels hingedly attached to each other and to a first end 712. The first foursomes 710/711 define the first corner post 510 and third corner post 518 of tray 502. A second foursome of sections 714/715 at a second end 716 define the second corner post 512 and fourth corner post 520.

Figure 5C:
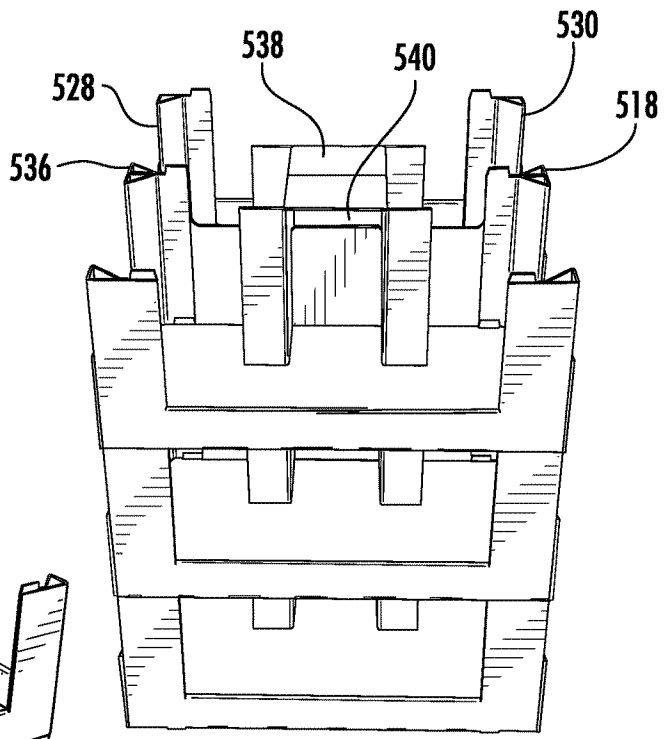
FIG. 5C is a side view of a tray system of FIG. 5A showing a window between the middle support and the joining wall.
Figure 5B:
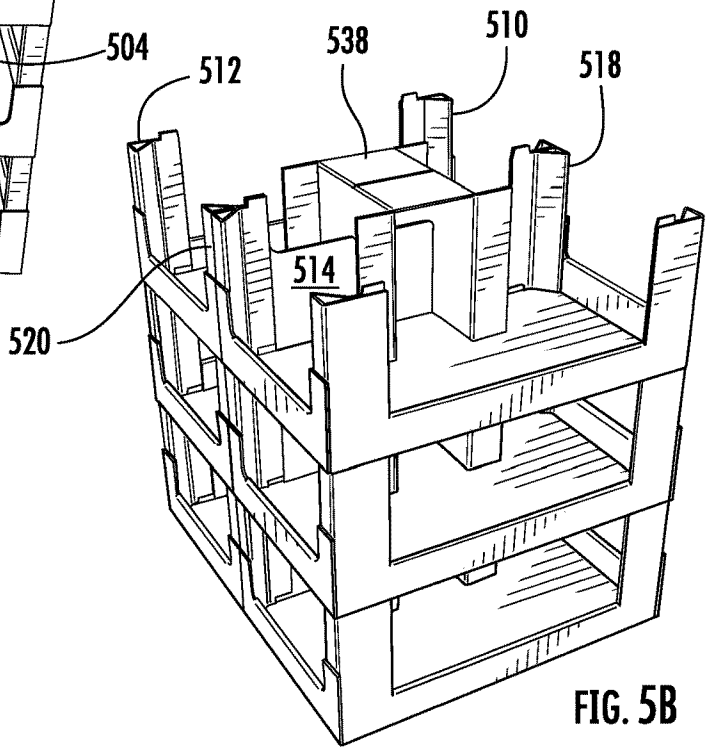
FIG. 5B is a perspective view of the system of FIG. 5A.
Figure 5A:
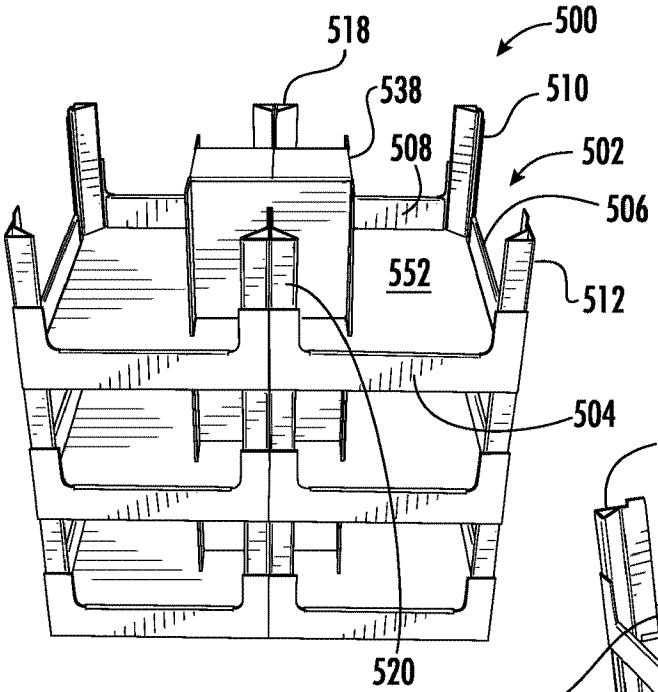
FIG. 5A is a front view of a tray of an exemplary embodiment of a tray system according to the disclosure.
Figure 6B:
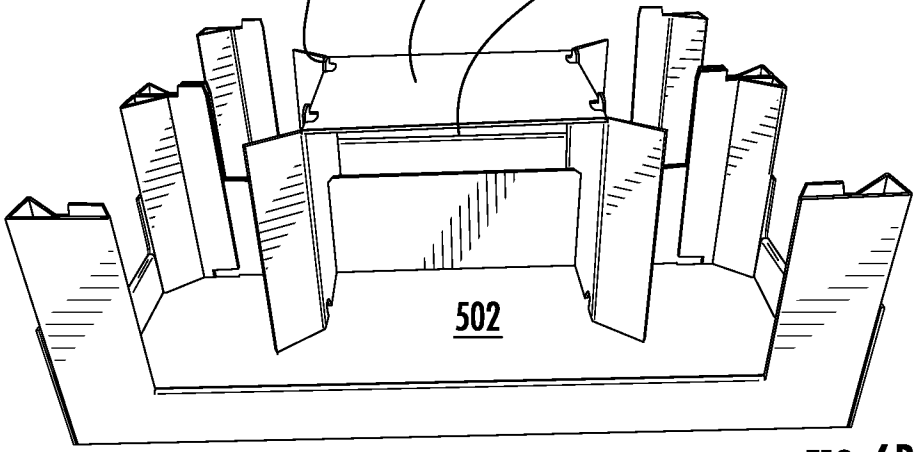
FIG. 6B is a Side view of an exemplary embodiment of a pair of trays of the tray system of FIG. 5A.
Figure 6A:
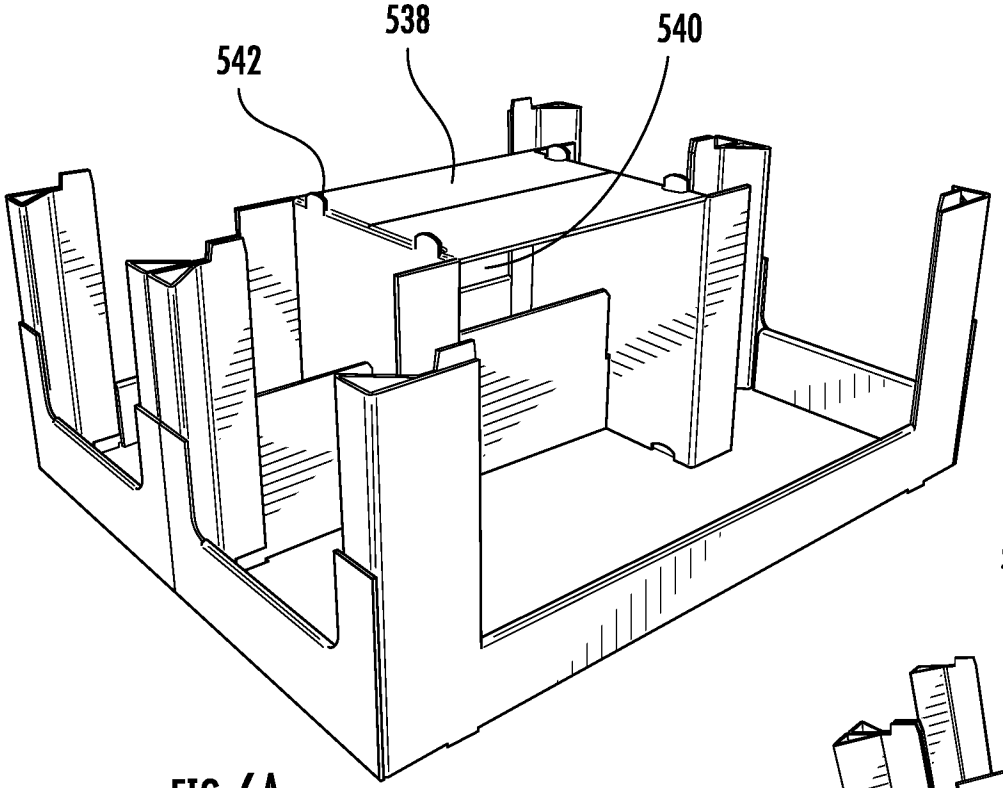
FIG. 6A is a perspective view of an exemplary embodiment of a pair of trays of the tray system of FIG. 5A showing an attachment of the joining member.
Figure 8:
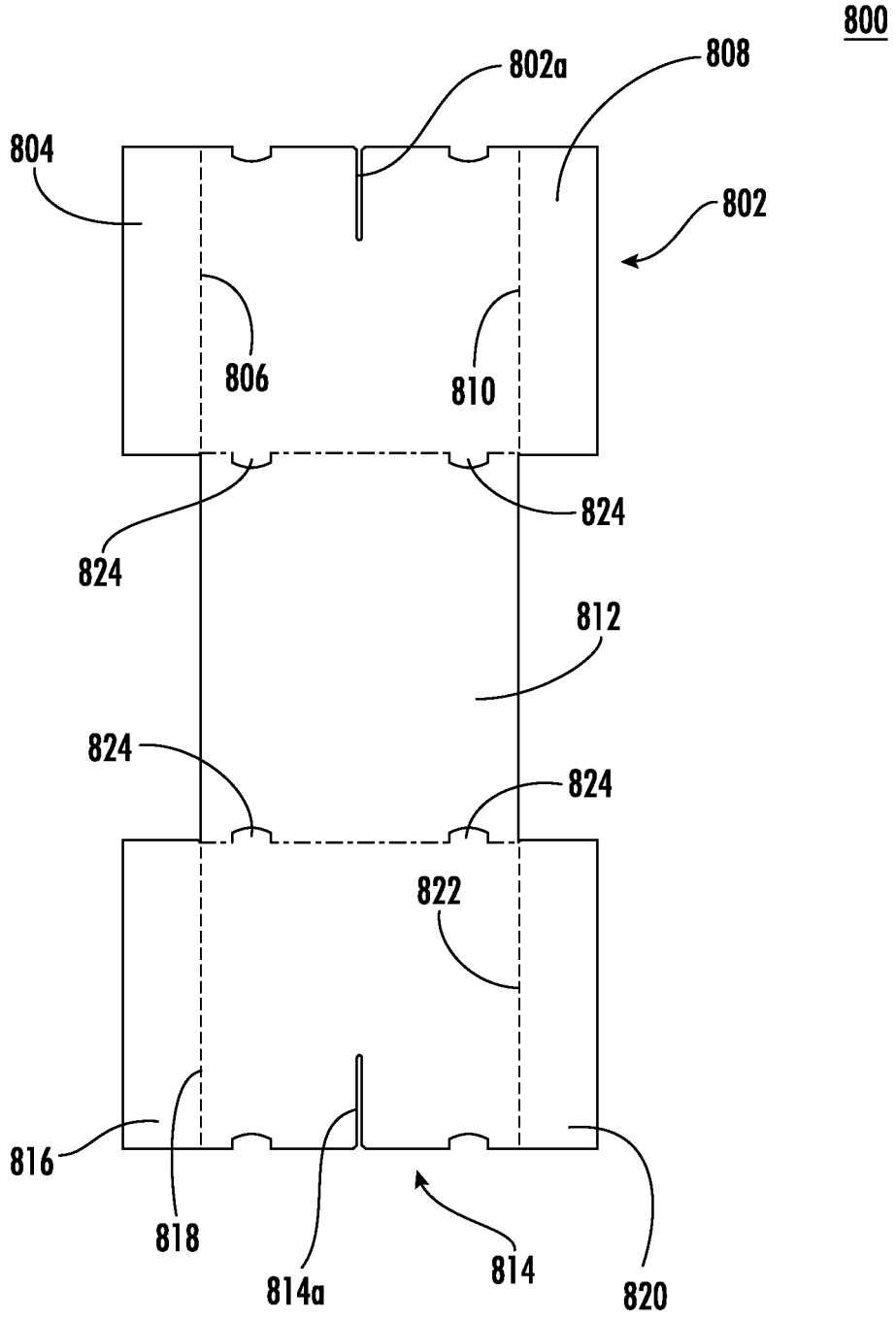
FIG. 8 is a plan view of a blank for constructing the joining member of FIGS. 1A and 5A.

FIG. 8 is a plan view of a blank 800 for constructing the joining member previously shown in FIGS. 1*a* and 5*a*. The blank 800 includes a first panel 802 forming the first support 144 of tray 102, a first end tab 804 hingedly attached to the first end 806 forming the first support wing 144*a* and a second end tab 808 hingedly attached to the second end 810 forming the second support wing 144*b*, a second panel 812 hingedly attached to the first panel defining the upper wall 142 of joining member 138 of tray 102. A third panel 814 includes a first end tab 816 defining the first support wing 146*a* hingedly attached to the first end 818 and a second end tab 820 defining the second support wing 146*b* hingedly attached to the second end 822. The second panel 812 includes a plurality of tabs 824 which bend in and out of the page to create the tabs 148 of tray 102. The first panel 802 and the second panel 814 each include a respective slot 802*a*/814*a* partially bisecting the respective panel in order to couple to the joining walls of tray 102.

Figure 9B:
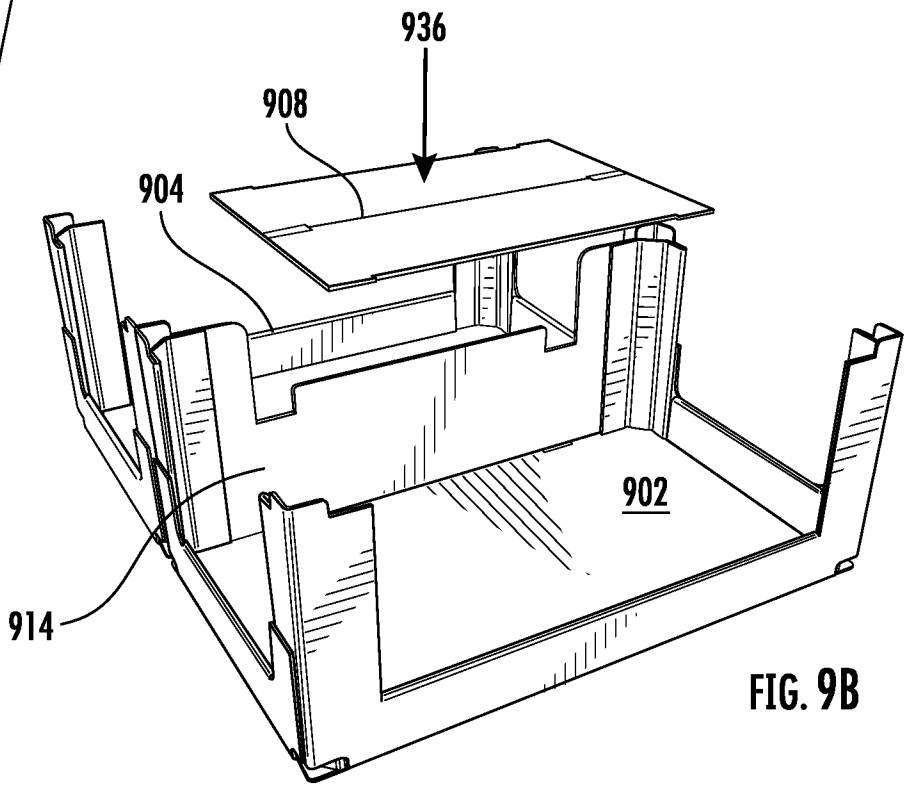
FIG. 9B is a perspective view of the tray system of FIG. 9A with a joining member being placed in place.
Figure 9A:
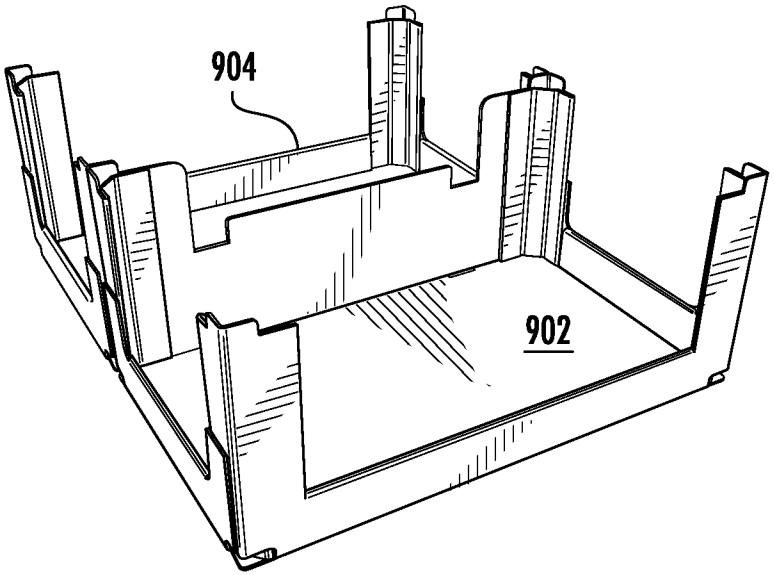
FIG. 9A is a perspective view of an exemplary embodiment of a tray system according to the disclosure.
Figure 9D:
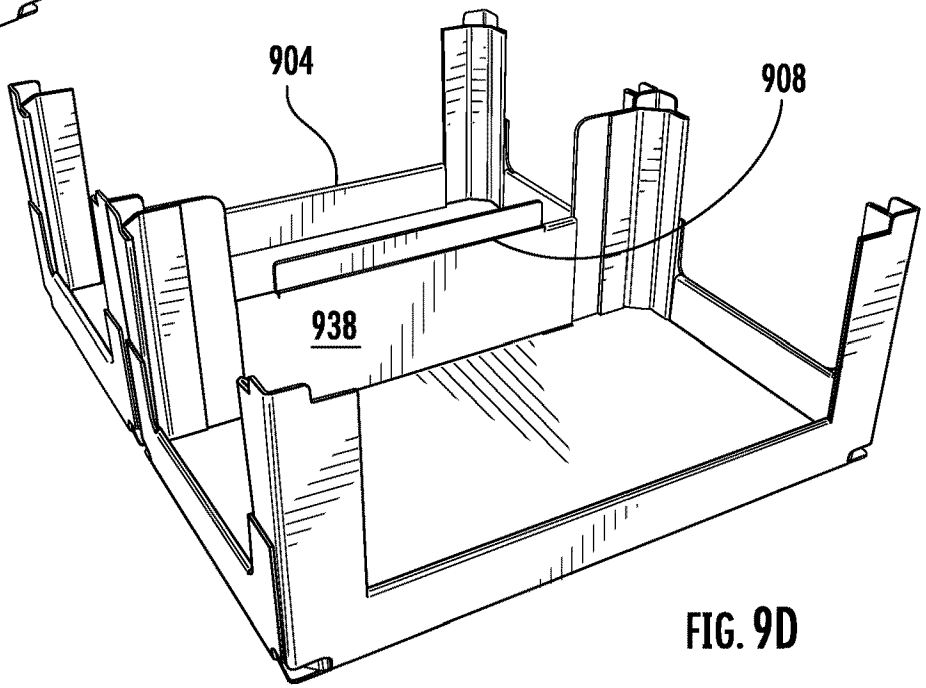
FIG. 9D is a perspective view of a tray system of FIG. 9A with the alternative joining member of FIG. 9C.
Figure 9C:
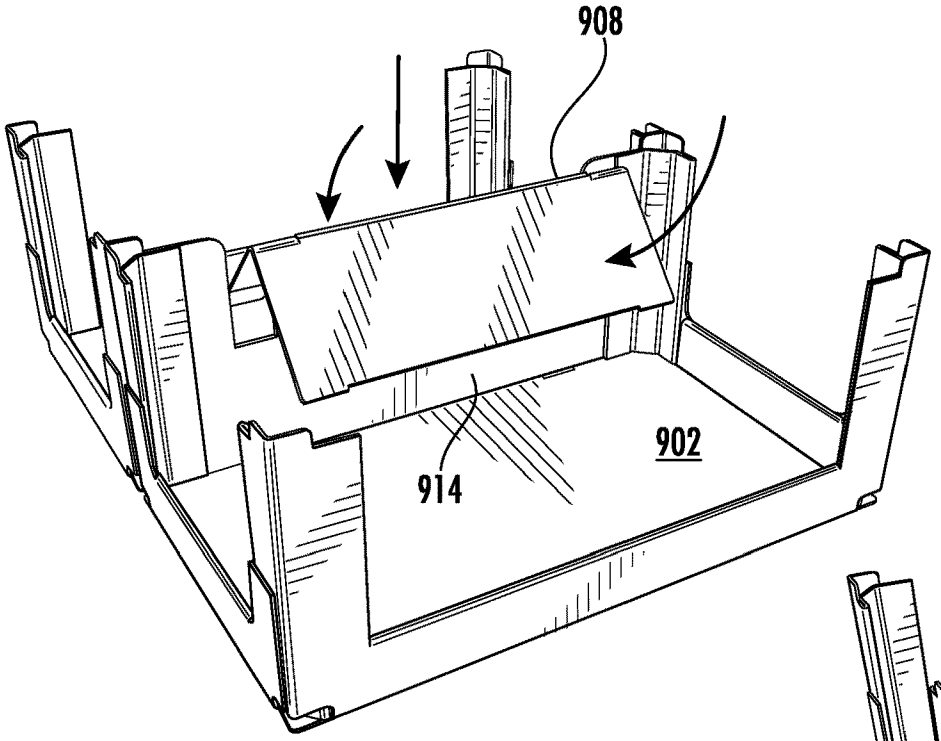
FIG. 9C is a perspective view of the tray system of FIG. 9A with an alternative joining member being placed in place.
Figure 9E:
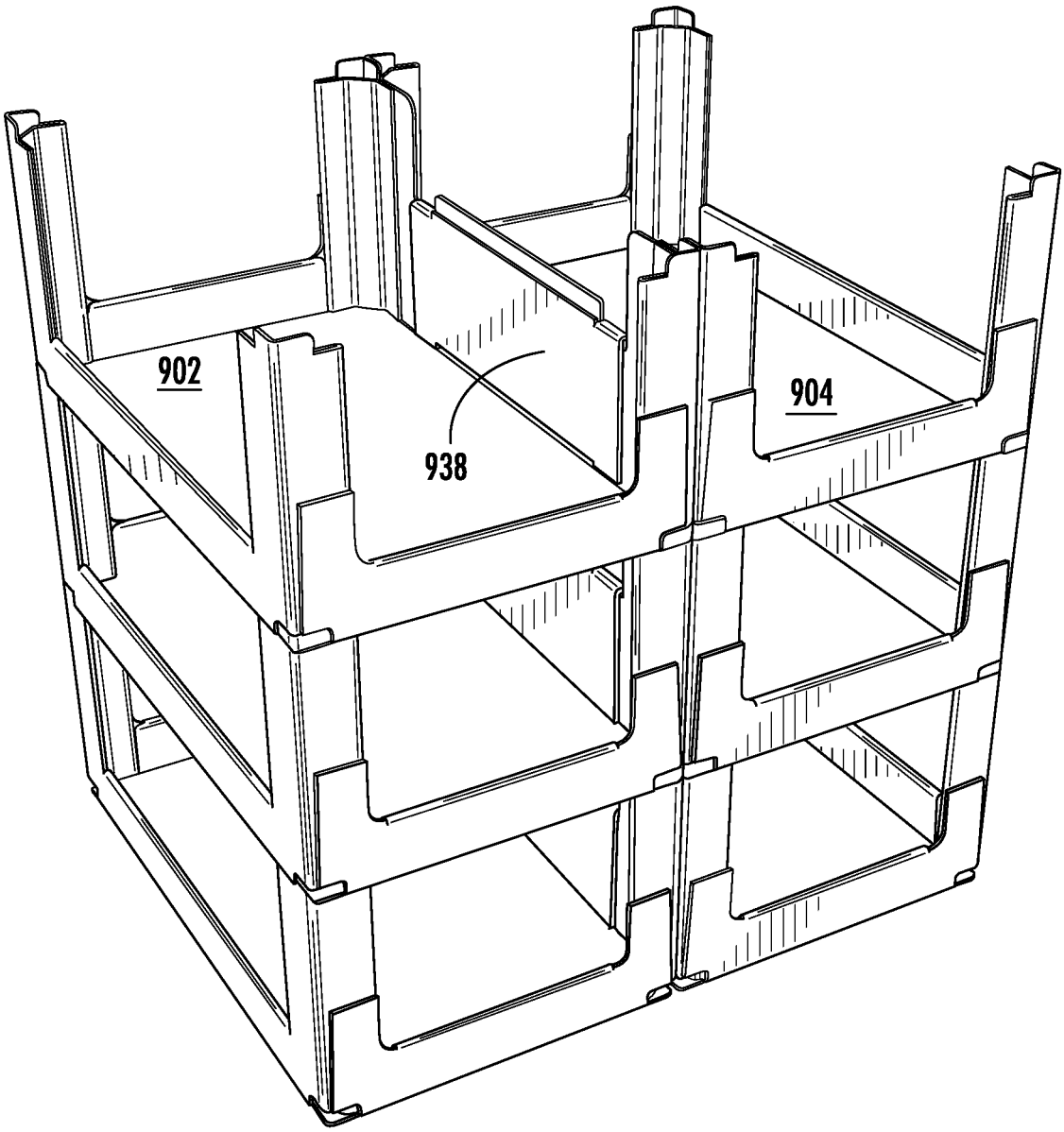
FIG. 9E is a perspective view of an exemplary embodiment of a tray system employing a divider showing in 9D.

FIG. 9A-9E are perspective views of an exemplary embodiment of a tray system according to the disclosure showing a variety of joining members being placed. FIG. 9B shows a two panel joining member 938 being folded over the joining walls 914 of the trays 902 and 904. Joining member 938 further includes a slit 908 placed in the middle of the panels not reaching the end, that slides over the joining walls 914 of trays 904 and 902. FIGS. 9C and 9D show joining member being placed over the joining walls 914. FIG. 9E shows a tray stack, with each tray having the joining member 938.

Figure 10A:
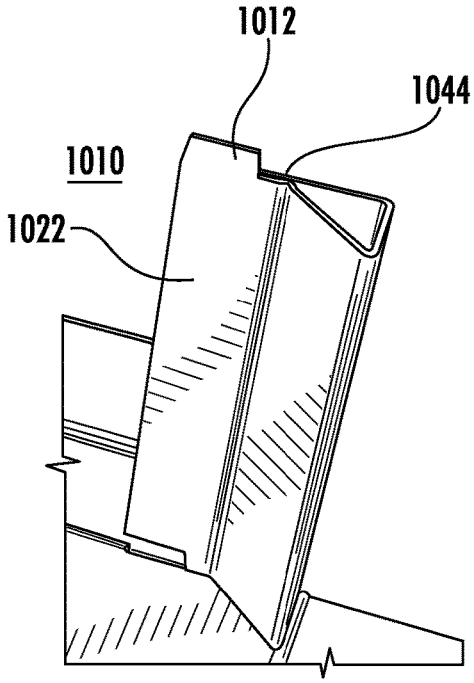
FIG. 10A is a perspective view of an open corner post with stacking tabs.
Figure 10B:
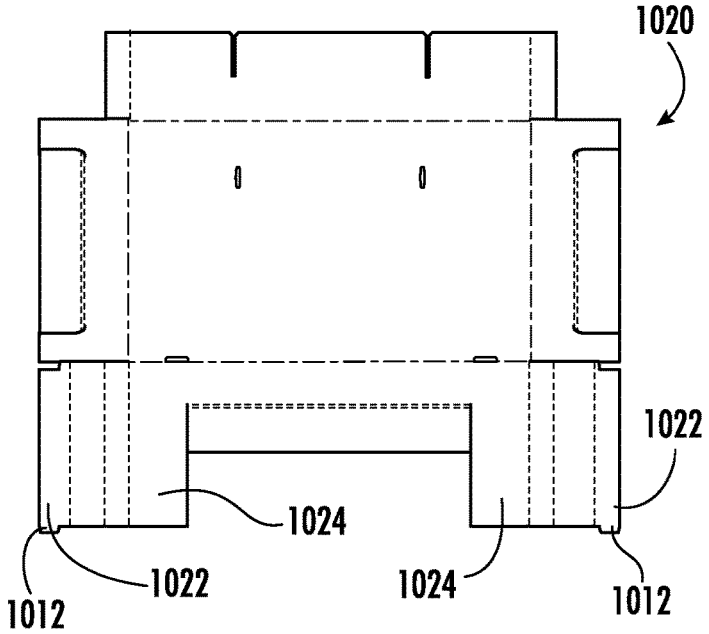
FIG. 10B is a plan view of a blank for constructing the corner post of FIG. 10A.
Figure 10C:
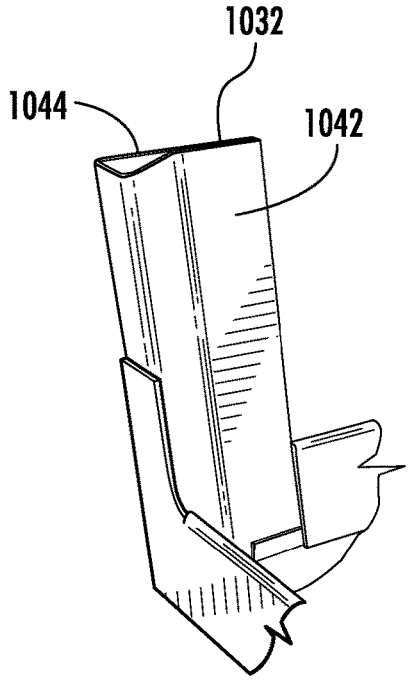
FIG. 10C is a perspective view of an open corner post without stacking tabs.
Figure 10D:
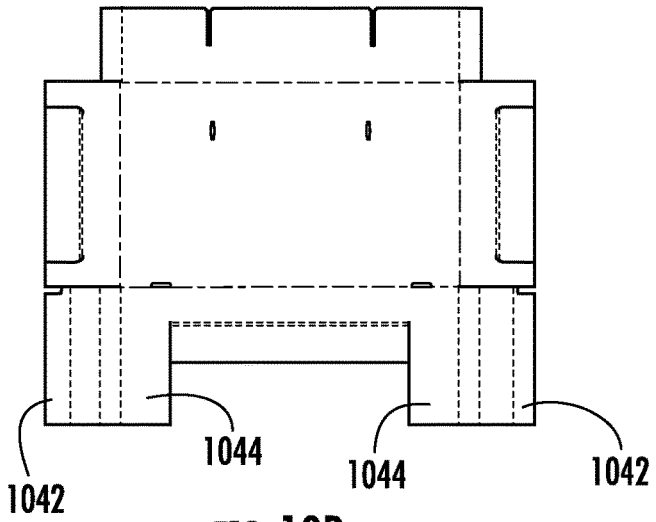
FIG. 10D is a plan view of a blank for constructing the corner post of FIG. 10C.
Figure 10E:
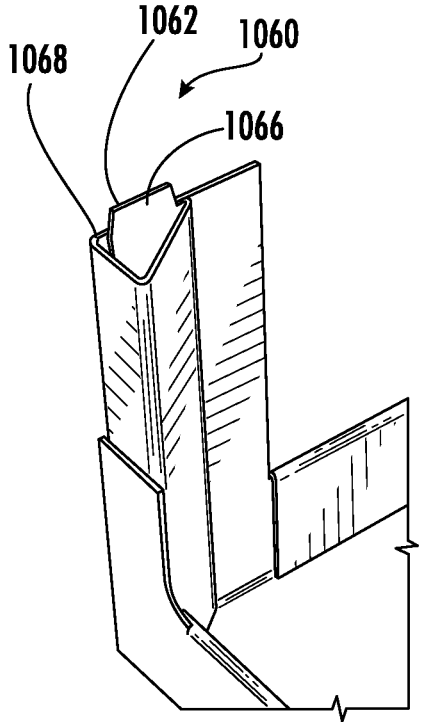
FIG. 10E is a perspective view of a closed corner post with stacking tabs.
Figure 10F:
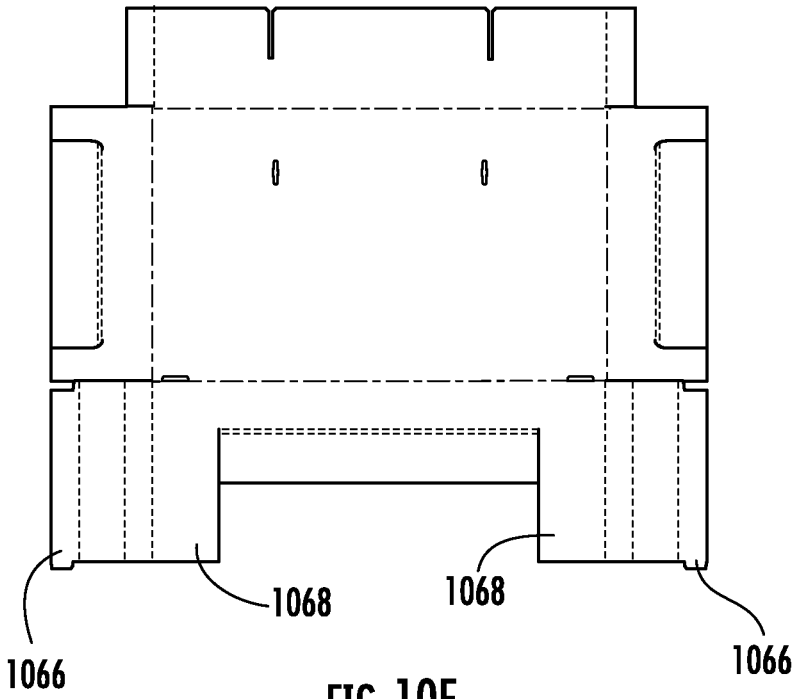
FIG. 10F is a plan view of a blank for constructing the closed corner post of FIG. 10E.
Figure 10G:
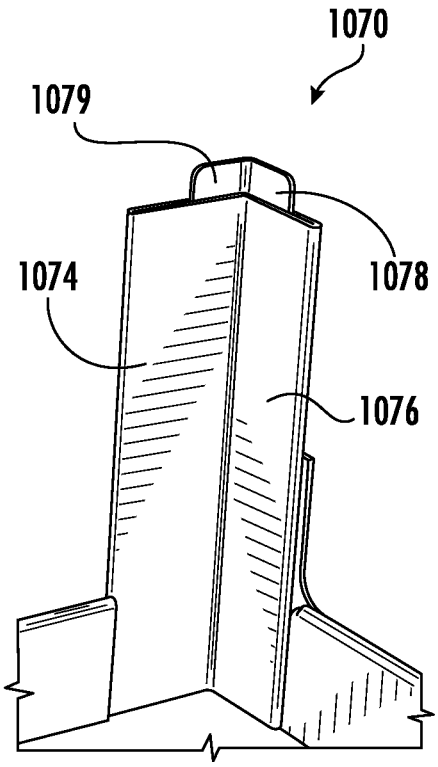
FIG. 10G is a perspective view of an "L" corner post.
Figure 10H:
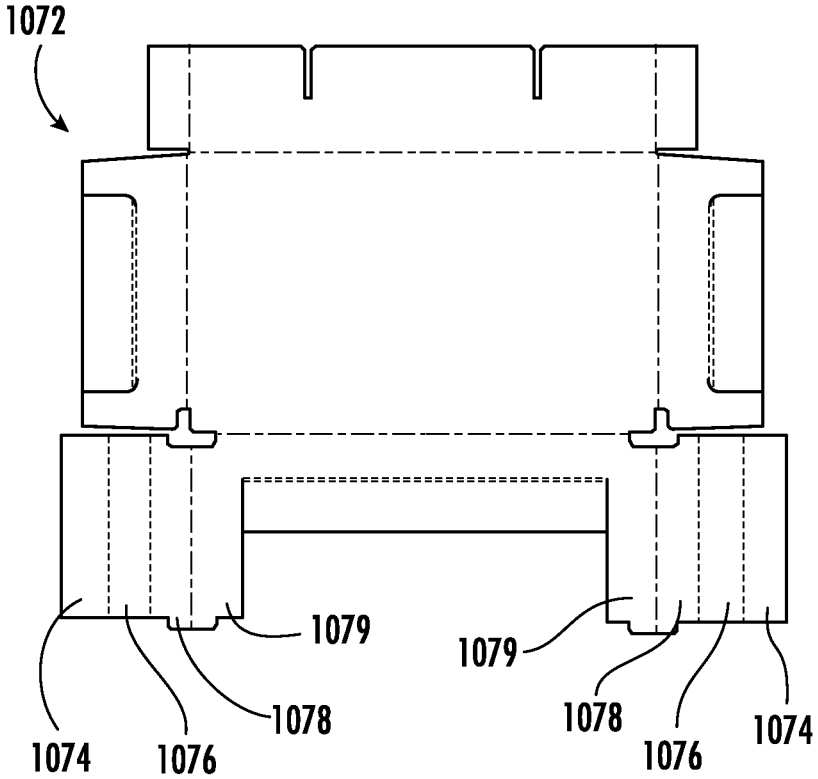
FIG. 10H is a plan view of a blank for constructing the corner post of FIG. 10G.
Figure 10I:
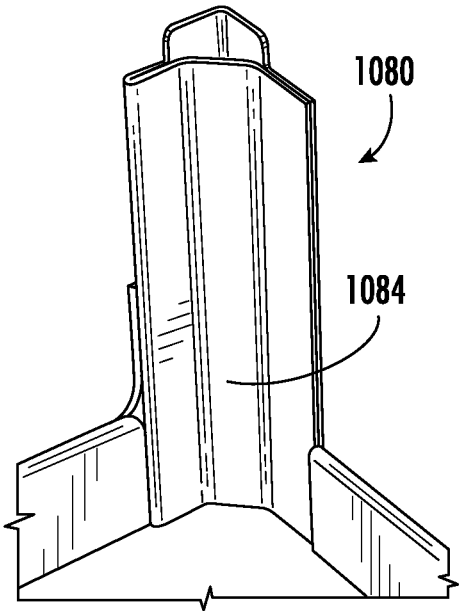
FIG. 10I is a perspective view of a five-panel "complex" corner post.
Figure 10J:
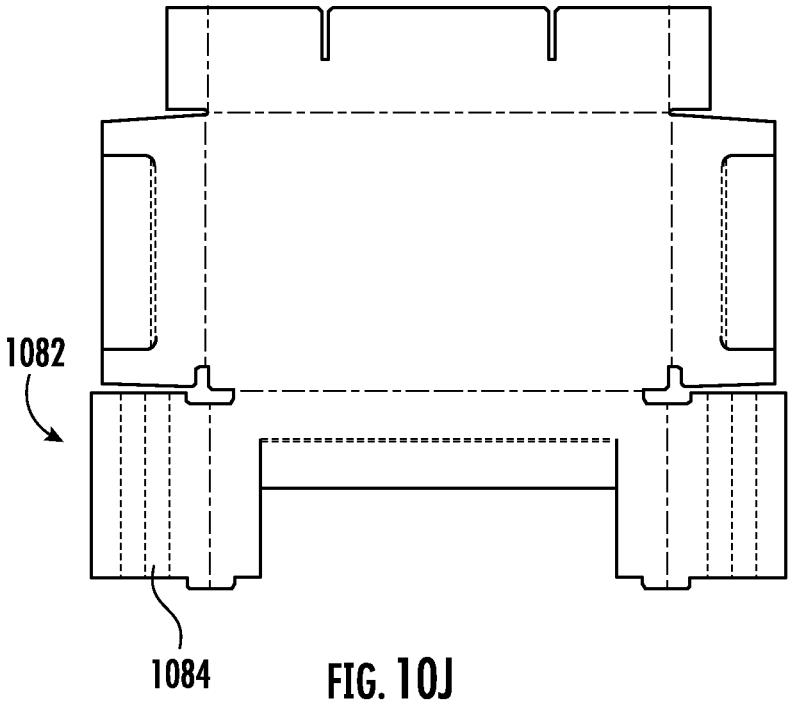
FIG. 10J is a plan view of a blank for constructing the "complex" corner post of FIG. 10I.

FIGS. 10A-10J shows a variety of corner posts that can be used with each of the tray systems discussed previously. FIG. 10*a* is a perspective view of an open corner post 1010 with stacking tab 1012 and FIG. 10B is a plan view of a blank 1020 for constructing the corner post of FIG. 10A. The outermost panel 1022 with the stacking tab 1012 folds inwards and attaches to the portion of the panel 1024 responsible for creating an outer wall of the tray in an inner-to-inner relationship. FIG. 10C is a perspective view of an open corner post 1032 and FIG. 10D is a plan view of a blank for constructing the corner post of FIG. 10C. Similarly, the outermost panel 1042 folds inwards and attaches to the portion of the panel 1044 responsible for creating an outer wall of the tray. FIG. 10E shows a perspective view of a closed corner post 1060 with stacking tabs 1062 and FIG. 10F is a plan view of a blank 1064 for constructing the corner post of FIG. 10E wherein the outermost panel 1066 folds inward and attaches to the main panel 1068, in an outer to inner relationship. FIG. 10G shows a perspective view of an "L" corner post 1070 and FIG. 10H is a plan view of a blank 1072 for constructing the corner post of FIG. 10G. Here the two outer most panels 1074 and 1076 both fold inward to form an inner-to-inner side relationship with the inner most panel 1078 and the main panel 1079. FIG. 10I shows a perspective view of a five-panel corner post 1080 and FIG. 10J is a plan view of a blank 1082 for constructing the corner post 1080 of FIG. 10I. This corner post 1080 employs five panels with the middle panels 1084 being in mitered position.

Figure 11A:
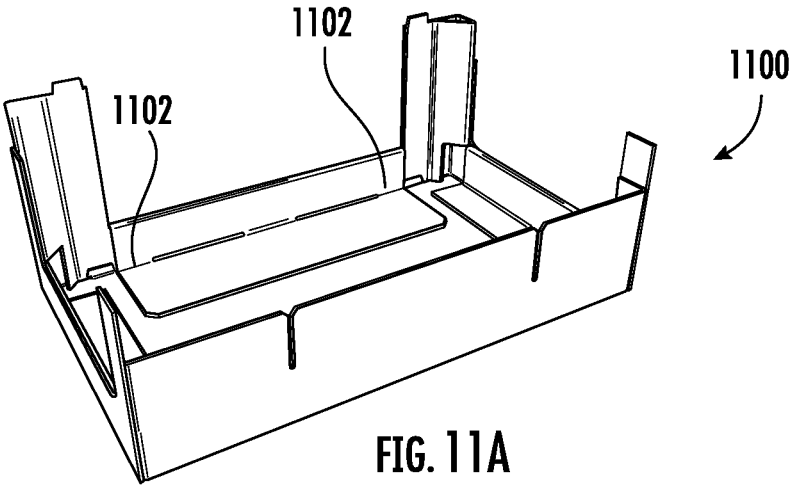
FIG. 11*a* is a perspective view of a self-locking tray.
Figure 11B:
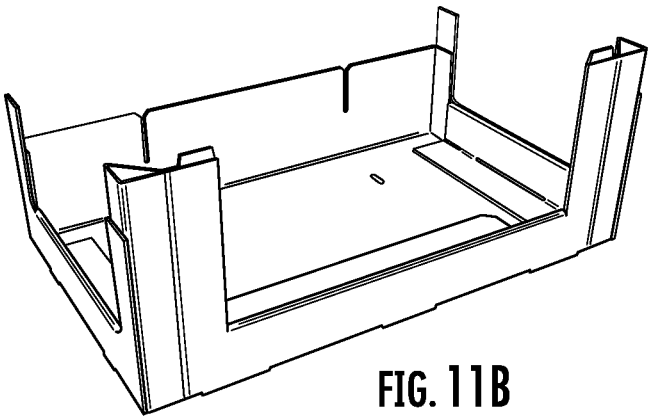
FIG. 11*b* is a perspective view of the self-locking tray of FIG. 11*a* showing a reverse side of the tray.
Figure 11C:
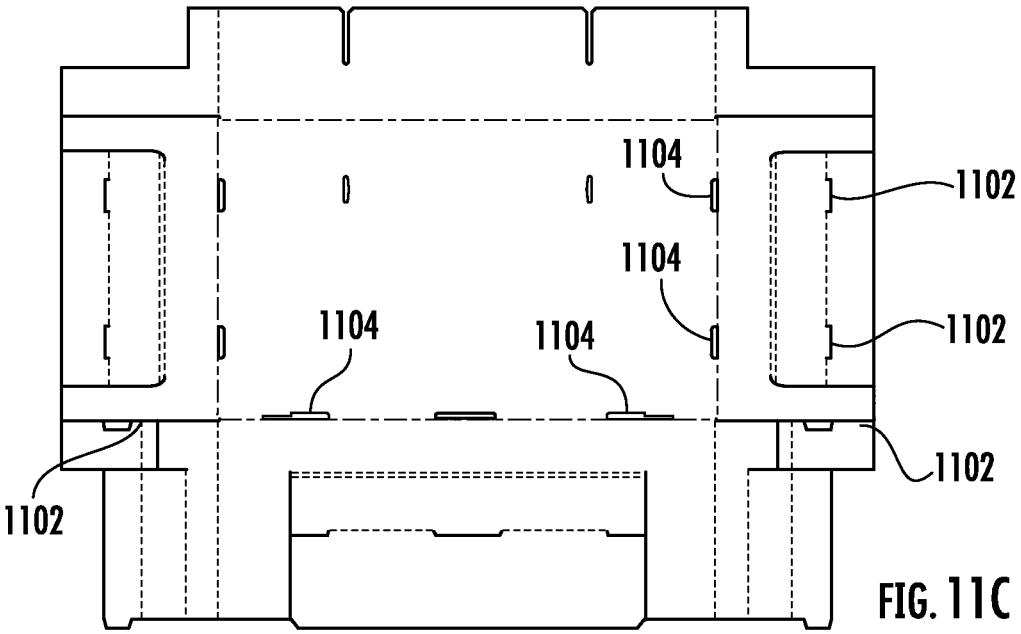
FIG. 11*c* is a plan view of the a blank for constructing the self-locking tray of FIG. 11*a;*.

FIGS. 11*a* and 11*b* are perspective views of a self-locking tray 1100. The tray 1100 is similar to tray 102 shown previously, but all of the folding is secured by tabs being placed into slots as a locking feature. FIG. 11*c* is a plan view of a blank for constructing the self-locking tray of FIGS. 11*a* and 11*b*. The tabs 1102 are meant to be placed into slots 1104 when the blank is folded in a manner similar to that of blank 102.

The methods and systems of the present disclosure, as described above and shown in the drawings, provide for a tray system and components thereof that allow for better stacking of trays and visibility within the trays. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A display tray system comprising:

a first tray having at least three outer walls defining an outer perimeter of the display tray system, a first corner having a first height at a junction of two of the at least three outer walls, a second corner having a height equal to the first corner at a junction of two of the at least three outer walls, a first joining wall defining an inner border with a second tray, a third corner at a junction of the joining wall and one of the at least three outer walls, a fourth corner at a junction of the joining wall and one of the at least three outer walls;

a second tray having at least three outer walls defining an outer perimeter of the display tray system, a first corner having a first height at a junction of two of the at least three outer walls, a second corner having a height equal to the first corner at a junction of two of the at least three outer walls, a second joining wall defining an inner border with the first tray, a third corner at a junction of the joining wall and one of the at least three outer walls, a fourth corner at a junction of the joining wall and one of the at least three outer walls; and a joining member coupled to the first joining wall of the first tray and coupled to the second joining wall of the second tray to couple the first and second trays together to provide vertical support in a stacked configuration, wherein the joining member includes an upper wall defining a horizontal plane at a vertical height equal to the height of the first corner and second corner of the first tray and the first corner and the second corner of the second tray.

2. The system of claim 1, wherein the upper wall of the joining member joins a first support to a second support.

3. The system of claim 2, wherein the first support is partially within the first tray and partially within the second tray.

4. The system of claim 2, wherein the first support includes a pair of support wings hingedly attached thereto and the second support includes a pair of wings hingedly attached thereto.

5. The system of claim 4, wherein the first support wing of the first support and the first support wing of the second support is within the first tray and the second support wing of the first support and the second support wing of the second support are within the second tray.

6. The system of claim 1, wherein an underside of the upper wall of the joining member and the upper edge of the first and second joining walls of the first tray and the second tray respectively define a top and a bottom of an opening.

7. The system of claim 1, wherein the upper wall includes a plurality of tabs configured to couple a third tray and a fourth tray placed above the first tray and above the second tray.

8. The system of claim 1, wherein the first joining wall of the first tray includes a height lower than the height of the first corner.

9. The system of claim 1, wherein the third corner of the first tray includes a height lower than the height of the first corner.

10. The system of claim 1, wherein the third corner of the first tray includes a height equal to the height of the first corner.

11. The system of claim 1, wherein the joining member is saddle shaped.

12. The system of claim 1, wherein the joining member extends to 60% or less into a width of the first tray, and wherein the joining member extends 60% or less inclusive into a width of the second tray.

13. The system of claim 1, wherein the joining member includes at least a pair of slots for coupling to the first joining wall of the first tray and coupling to the second joining wall of the second tray.

14. The system of claim 1, wherein the joining member is folded over the first and second joining walls in a face-to-face relationship.

15. The system of claim 14, wherein the joining member includes a first panel hingedly coupled to a second panel.

16. The system of claim 15, wherein the first panel includes a punch-out portion and the second panel include an aperture for receiving the punch-out portion of the first panel.

17. The system of claim 1, wherein the first tray includes a floor having at least one slot for accepting a tab of a joining member of a third tray.

18. The system of claim 1, further comprising a third tray joined to a fourth tray by a second joining member, wherein the third tray and fourth tray are joined to the joining member of the first tray and the second tray.

* * * * *